United States Patent [19]

Cantrell

[11] 4,343,319

[45] Aug. 10, 1982

[54] CIGARETTE FILTER

[75] Inventor: Daniel V. Cantrell, Prospect, Ky.

[73] Assignee: Brown & Williamson Tobacco Corporation, Louisville, Ky.

[21] Appl. No.: 210,877

[22] Filed: Nov. 28, 1980

[51] Int. Cl.[3] ..... A24B 3/04

[52] U.S. Cl. ..... 131/336; 131/338; 131/339

[58] Field of Search ..... 131/336, 338, 339, 340, 131/341, 198 R, 198 A

[56] References Cited

U.S. PATENT DOCUMENTS 3,490,461 1/1970 Osmalov et al. ..... 131/336

3,910,288 10/1975 Hammersmith et al. ..... 131/340

*Primary Examiner*—V. Millin

*Attorney, Agent, or Firm*—Charles G. Lamb

[57] ABSTRACT

A filter for a cigarette includes a porous filter rod with at least one opening in each end thereof with at least one longitudinal groove embedded into the outer periphery of the rod intermediate the openings and in flow communication therewith. The filter rod is wrapped with non-porous plug wrap and overlaid with porous tipping material with the flow-through groove being between the plug wrap and the tipping material so that a portion of the smoke coming from a tobacco column mixes with ventilating air in the groove and the remaining portion of the tobacco smoke passes through the filter, with little or no contact with ventilating air until it reaches the smoker's mouth.

11 Claims, 11 Drawing Figures

CIGARETTE FILTER

BACKGROUND OF THE INVENTION

1. Field of the Invention

This invention relates to filters for cigarettes. In one aspect, it relates to a filter with novel ventilating means therein. In another aspect, the invention relates to a filter cigarette having flow directing grooves therein for mixing with a portion of the tobacco smoke while the remaining portion of the tobacco smoke passes through the filter without mixing the ventilating air.

2. Description of the Prior Art

It is well known in the art of filter cigarettes to provide filters with ventilating means to bring in ambient air to the filter to dilute the smoke stream. The dilution of the smoke stream reduces the quantity of smoke particulates as well as gas phase components which are delivered to the mouth of the smoker. A number of means have been proposed and are utilized for introducing ventilating air into the cigarette. For example, the wrapper for the tobacco in a cigarette can be made from a porous material which allows for introduction of air along the entire length of the cigarette where it mixes with the smoke stream passing therethrough thereby diluting the smoke in the stream prior to entering the smoker's mouth. Also, the cigarette wrapper may be perforated at selected locations along the length of the cigarette which provides ports for the cigarette through which ventilating air enters. Even further, it is known to perforate the wrapper of the filter on the filter end of the cigarette to allow for ventilating air to enter the filter for dilution of the smoke stream. There have also been a number of suggestions for incorporating grooves within the filter plug for the cigarette in order to facilitate the addition of ventilating air into the smoke stream. These include for example U.S. Pat. No. 3,596,663; 3,577,995; 3,572,347; 3,490,461; 1,718,122; 3,788,330; 3,773,053; 3,752,165; 3,638,661; 3,608,561; and, 3,910,288.

There have also been a number of suggestions for incorporating channels within the filter plug for the cigarette in order to facilitate addition of ventilating air into the smoke stream. These include for example U.S. Pat. Nos. 3,416,541; 3,910,288; 3,773,883; 3,581,748; 3,045,680; and, 1,996,990.

SUMMARY OF THE INVENTION

The present invention advantageously provides a straight forward arrangement of a filter for a cigarette which achieves lower or normal cigarette pressure drop with low to moderate efficiency filters. The present invention further provides a cigarette filter for lowering tar by combining ventilation with filtration. The present invention even further provides a filter ventilation system for cigarettes utilizing grooves and channels in the filter plugs for mixing ventilating air with tobacco smoke. The present invention also provides a groove filter with a non-porous plug wrap.

In the present invention, smoke leaving the tobacco column is split into two portions, one portion passing through an opening in the filter rod which communicates with a groove or channel which is also in flow communication with ventilating air. The remaining portion of smoke passes through the filter.

Various other features of the present invention will become obvious to those skilled in the art upon reading the disclosure set forth hereinafter.

More particularly, the present invention provides a filter for a cigarette comprising a porous filter rod of substantially cylindrical configuration circumscribed by a smoke impervious plug wrap, the filter rod having at least one opening in each end thereof and at least one groove extending along the outer periphery of the rod and the wrapper intermediate the openings and in flow-through communication with the openings, the groove being in flow communication with ventilating air.

It is to be understood that the descriptions of the examples of the present invention given hereinafter are not by way of limitation and various modifications within the scope of the present invention will occur to those skilled in the art upon reading the disclosure set forth hereinafter.

BRIEF DESCRIPTION OF THE DRAWINGS

Referring to the drawing

DESCRIPTION OF THE PREFERRED EMBODIMENT

Figure 1:
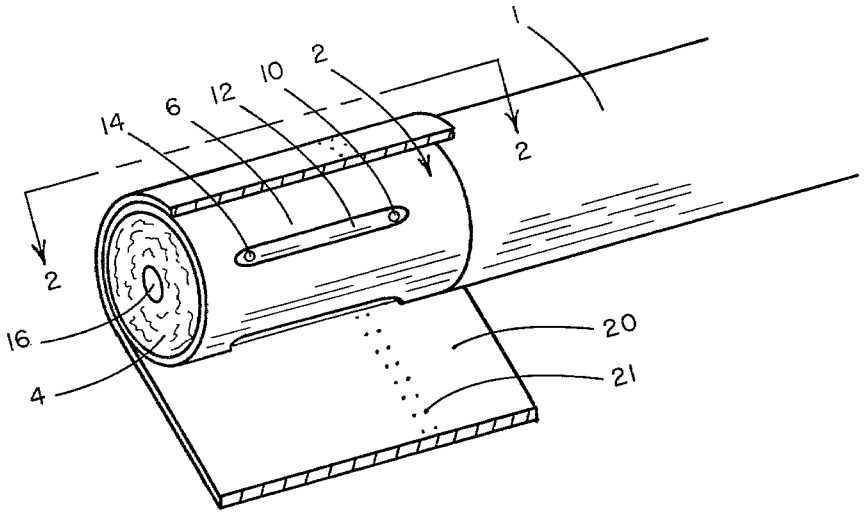
FIG. 1 is a perspective view illustrating a cigarette having one preferred filter structure of the present invention.

In FIG. 1, a filter plug 2 of the present invention is shown attached to a cigarette tobacco column 1. Filter plug 2 comprises a cellulose acetate filter element 4 or any other filter made from fibrous or foam materials for tobacco smoke which may be known in the art, circumscribed by a non-porous or smoke impervious wrapper 6. It is realized that, in the use of the term "smoke impervious" or "non-porous wrapper", this includes non-porous outer surfaces of foam material which are integral with the filter element as well as non-porous wrapping materials which are not integral with the filter element.

Figure 2:
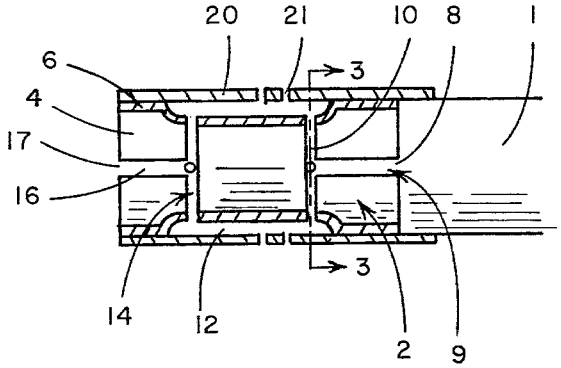
FIG. 2 is a longitudinal sectional view taken along a plane passing along section line 2—2 of FIG. 1.
Figure 3:
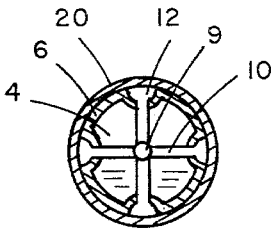
FIG. 3 is a transverse sectional view taken along a plane passing along section line 3—3 of FIG. 2.

In FIG. 2, the filter plug 2 is provided with an opening 8 in the end thereof in communication with the tobacco column 1. The opening 8 defines the inlet into a centrally disposed axially extending channel 9 which extends a preselected distance into the filter rod, and as best shown in FIGS. 2 and 3, is in flow communication with radially or transversely extending groove connecting channels 10. Embedded into the outer periphery of the filter rod is a plurality of longitudinally extending grooves 12 which are in flow communication with the transversely extending channels 10. Each groove 12 extends a preselected distance along the outer periphery of the filter and intermediate thereof connecting with radially or transversely extending groove connecting channels 14. The transversely extending channels 14 interconnect with a centrally disposed axially extending channel 16 which extends longitudinally to the opposite or the mouth end of the filter.

Circumscribing the wrapper 6 is an air pervious tipping paper 20, tipping paper 20 being shown with two rows of perforations 21 therein, it being realized that only one row of perforations or other flow through means may be provided. The perforations 21 are in flow communication with the grooves 12.

In the use of the filter of the present invention as shown in FIGS. 1, 2 and 3, when tobacco smoke enters the filter, a portion of the smoke travels through the filter rod 4 and the remaining portion of the smoke travels through the area of least resistance, that being the center longitudinally extending channel 9. This smoke then splits to one of the intersecting transversely extending channels 10 and then moves outwardly to be swept along one of the intersecting longitudinally extending grooves 12 where it becomes mixed or diluted with ventilating air entering the grooves 12 through the perforations 21 of the porous tipping paper 20. The diluted smoke swept down the groove 12 between the porous tipping paper 20 and the non-porous plug wrap 6 flows into the intersecting transversely extending channels 14. The ventilated smoke then exits through the connecting center longitudinally extending channel 16. The portion of the smoke that does not get swept into the channel portions of the filter plug is filtered as it passes through the filter material under normal smoke draw.

Figure 4:
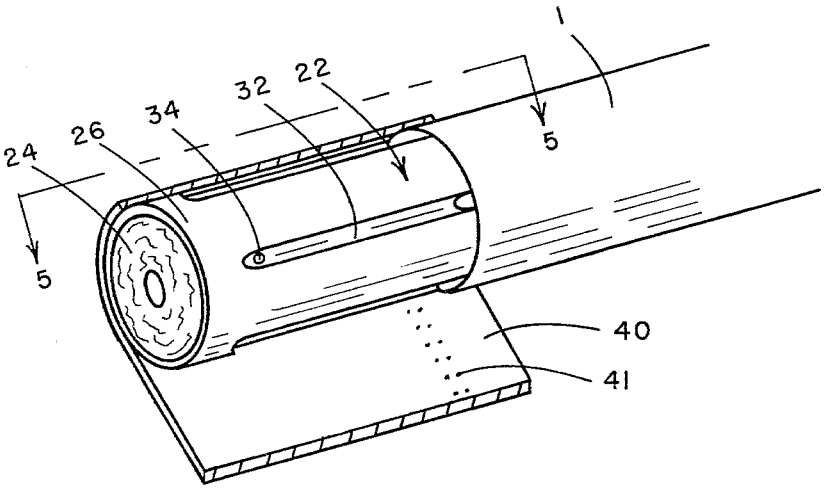
FIG. 4 is a perspective view illustrating a cigarette having another preferred filter structure of the present invention.
Figure 5:
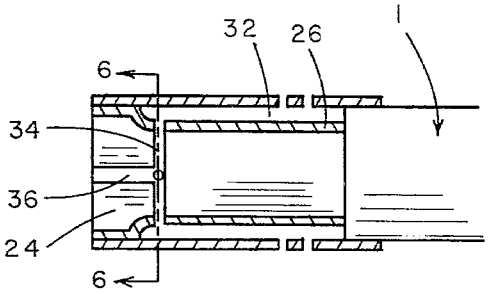
FIG. 5 is a longitudinal sectional view taken along a plane passing along section line 5—5 of FIG. 4.
Figure 6:
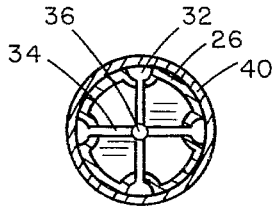
FIG. 6 is a transverse sectional view taken along a plane passing along section line 6—6 of FIG. 5.
Figure 7:
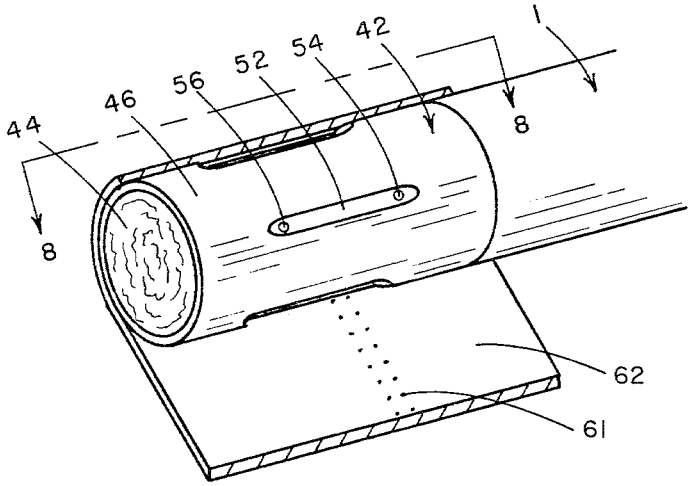
FIG. 7 is a perspective view illustrating a cigarette having even another preferred filter structure of the present invention.
Figure 8:
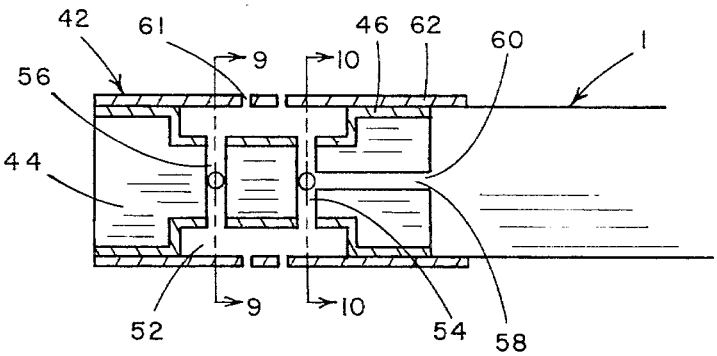
FIG. 8 is a longitudinal sectional view taken along a plane passing along section line 8—8 of FIG. 7.
Figure 9:
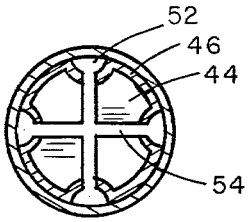
FIG. 9 is a transverse sectional view taken along a plane passing along section line 9—9 of FIG. 8.
Figure 10:
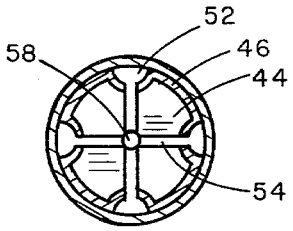
FIG. 10 is a transverse sectional view taken along a plane passing along section line 10—10 of FIG. 8; and, FIG. 11 is a perspective view illustrating a cigarette having a filter structure of FIG. 7 attached thereto wherein the ends of the filter attached to the cigarette are reversed.

In FIG. 4, a filter plug 22 of the present invention is shown attached to a cigarette tobacco column 1. This filter plug 22 comprises a cellulose acetate filter element 24 or any other filter made from fibrous or foam materials for tobacco smoke which may be known in the art circumscribed by a non-porous wrapper 26. The filter plug 22 is provided with a plurality of longitudinally extending grooves 32 embedded in the outer periphery thereof. Grooves 32 terminate at one end at the tobacco column 1 and the other end, as best shown in FIGS. 5 and 6, connect with radially or transversely extending groove connecting channels 34. The transversely extending channels 34 interconnect with a centrally disposed axially aligned channel 36 which extends longitudinally to the opposite or mouth end of the filter.

In the use of the filter of the present invention as shown in FIGS. 4, 5 and 6, tobacco smoke entering the filter is split into two portions. One portion of the smoke travels through the filter rod 24 and the remaining portion of the smoke travels through the area of least resistance, that being the longitudinally extending grooves 32. This smoke is then swept along the longitudinally extending grooves 32 where it becomes mixed or diluted with ventilating air entering the grooves 32 through the perforations 41 in the air pervious tipping paper 40. The diluted smoke swept down the grooves 32 between the tipping paper 40 and the plug wrap 26 flows into the intersecting transversely extending channels 34. The ventilated air-smoke stream then exits through the connecting center longitudinally extending channel 36. The portion of the smoke that virtually does not get mixed with ventilating air in the grooves 32 is filtered as it passes through the filter material under normal smoke draw.

In FIGS. 7, 8, 9, and 10, a filter plug 42 of the present invention is shown attached to a cigarette tobacco column 1. This filter plug 42 comprises a cellulose acetate filter element 44 or any other filter made from fibrous or foam materials for tobacco smoke which may be known in the art circumscribed by a non-porous wrapper 46. The filter plug 42 is provided with a plurality of longitudinally extending grooves 52 embedded in the outer periphery thereof. Each groove 52 extends a preselected distance along the outer periphery of the filter and intermediate thereof connecting with radially or transversely extending groove connecting channels 54 at one end and 56 at the other. Connecting channel 54 is in flow communication with a centrally disposed axially extending channel 58 which extends from opening 60 in one end of the filter a preselected distance into the filter rod. Connecting channels 56 extend radially into the filter connecting with each other at the central axis of the filter rod.

Circumscribing the wrapper 46 is an air pervious tipping paper 62, tipping paper 62 being shown with two rows of perforations 61 therein, perforations 61 being in flow communication with the grooves 42.

In the use of the filter of the present invention as shown in FIG. 7, 8, 9, and 10, tobacco smoke entering the filter is split into two portions. One portion of the smoke travels through the filter rod 44 and the remaining portion of the smoke travels through the area of least resistance, that being the center longitudinally extending channel 58. This smoke then splits to one of the intersecting channels 54 and then moves outwardly to be swept along one of the intersecting longitudinally extending grooves 52 where it becomes mixed or diluted with ventilating air entering the grooves 52 through the perforations 61 in the air pervious tipping paper 62. The diluted smoke swept down the grooves 52 between the tipping paper 62 and the plug wrap 46 flows into the intersecting transversely extending channels 56. The ventilated air-smoke stream then enters the body of the filter substantially at the center thereof to mix with the filter rod smoke just prior to leaving the filter material under normal smoke draw.

Figure 11:
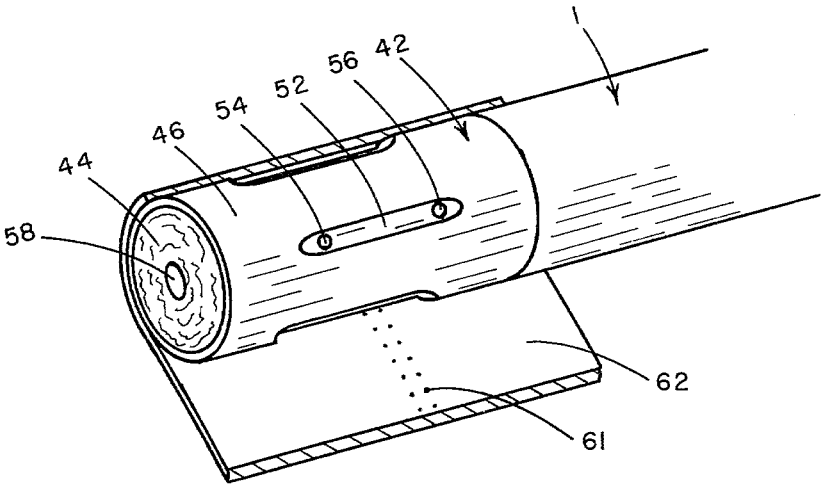

In FIG. 11, the same filter element as shown in FIG. 7, 8, 9, and 10, and described hereinbefore is connected to the cigarette tobacco column 1. In FIG. 11 the filter attached to the tobacco column 1 is reversed. That is, the channel 58 is disposed as a passageway for the mixture of ventilating air and smoke in leaving the filter whereas in FIG. 7 channel 58 is in the end of the filter attached to and in flow communication with the tobacco column 1.

In the use of the filter as shown in FIG. 11, tobacco smoke enters the filter and intermediate thereof a portion of the partially filtered smoke enters one of the intersecting channels 56 and then moves outwardly to be swept along one of the intersecting longitudinally extending grooves 52 where it becomes mixed or diluted with ventilating air entering the grooves 52 through the perforations 61 in the air pervious tipping paper 62. The diluted smoke swept down the grooves 52 between the tipping paper 62 and the plug wrap 46 flows into the intersecting transversely extending channels 54. The ventilated air-smoke stream then enters the body of the filter, one portion of the stream mixing with the smoke being filtered therein and the remaining portion exits through the connecting center longitudinally extending channel 58.

Thus, it will be realized that various changes may be made to the specific embodiments shown and described without departing from the scope and spirit of the present invention.

What is claimed is:

1. A cigarette filter comprising:

a porous filter rod of substantially cylindrical configuration circumscribed by a smoke impervious plug wrap, the filter rod having at least one opening in at least one end thereof and at least one longitudinally extending groove embedded into the outer periphery of the rod and the wrapper and longitudinally spaced from said at least one opening and in flow-through communication with said at least one opening wherein said at least one opening is in flow communication with a longitudinally extending hollow channel disposed centrally of said filter rod and extending a distance less than the length of the filter rod, said longitudinal channel interconnecting with groove connecting channels, said groove connecting channels being in flow communication with said groove, the groove being in flow communication with ventilating air.

2. The cigarette filter of claim 1 including a flow-through channel connecting said groove in flow-through communication into said filter rod.

3. The cigarette filter of claim 1 in combination with a cigarette tobacco column wherein said at least one opening is in flow communication with said cigarette tobacco column.

4. The cigarette filter of claim 1 in combination with a cigarette tobacco column wherein said at least one opening is opposite the end attached to said cigarette tobacco column.

5. The cigarette filter of claim 1 wherein said filter rod includes an opening in the end opposite said at least one end, said filter includes a second longitudinally extending channel at end opposite said at least one end in flow communication with said opening at said opposite end and at least one groove connecting channel interconnecting with each longitudinal channel, said groove connecting channel being connectable with said groove.

6. The cigarette filter of claim 1, at least one opening of one end defining an inlet into said at least one groove.

7. The cigarette filter of claim 1, said groove having an outlet spaced from said inlet connectable with a groove connecting channel, said groove connecting channel being connectable with a centrally disposed longitudinally extending channel, said longitudinally extending channel being in flow communication with the opening of said other end.

8. The cigarette filter of claim 1 including air pervious tipping material circumscribing said plug wrap and spaced therefrom when enclosing said groove.

9. The cigarette filter of claim 8 wherein said tipping material is attached to the outer surface of said plug wrap.

10. The cigarette filter of claim 8, said tipping material having selective perforations therein in flow-communication with said groove.

11. The cigarette filter of claim 1, said plug wrap being integral with said porous filter rod.

* * * * *